US007096976B2

(12) United States Patent
Paluch et al.

(10) Patent No.: US 7,096,976 B2
(45) **Date of Patent: *Aug. 29, 2006**

(54) DRILLING FORMATION TESTER, APPARATUS AND METHODS OF TESTING AND MONITORING STATUS OF TESTER

(75) Inventors: William C. Paluch, Jersey Village, TX (US); Alois Jerabek, Houston, TX (US); Paul D. Ringgenberg, Spring, TX (US); Michael Hooper, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/317,319

(22) Filed: Dec. 12, 2002

(65) Prior Publication Data

US 2003/0234120 A1 Dec. 25, 2003

Related U.S. Application Data

(63) Continuation of application No. PCT/US00/30595, filed on Nov. 6, 2000.

(60) Provisional application No. 60/165,229, filed on Nov. 5, 1999.

(51) Int. Cl.
*E21B 44/00* (2006.01)
*E21B 49/08* (2006.01)

(52) U.S. Cl. ..... 175/48; 175/59; 166/66; 166/250.17; 73/152.19; 73/152.28; 73/152.46

(58) Field of Classification Search ..... 166/250.01, 166/254.1, 254.2, 66, 250.17, 250.07; 175/40, 175/48, 59, 50, 58; 73/152.02, 152.03, 152.17, 73/152.18, 152.19, 152.21, 152.22, 152.23, 73/152.28, 152.43, 152.46

See application file for complete search history.

(56) References Cited

U.S. PATENT DOCUMENTS

| | | | | |
|---|---|---|---|---|
| 1,619,328 | A | 3/1927 | Benckenstein | |
| 2,978,046 | A | 4/1961 | True | |
| 3,111,169 | A | 11/1963 | Hyde | |
| 3,964,556 | A * | 6/1976 | Gearhart et al. | 175/45 |

(Continued)

FOREIGN PATENT DOCUMENTS

| | | |
|---|---|---|
| EP | 0697501 | 2/1996 |

OTHER PUBLICATIONS

The Expro Group, "Reservoir Fluid Sampling Tool", 102-CH/008, Rev 04-09/01.

(Continued)

*Primary Examiner*—Jennifer H. Gay
(74) *Attorney, Agent, or Firm*—Conley Rose, P.C.

(57) ABSTRACT

An integrated drilling and evaluation system includes a drill string having an interior portion and a drill bit, carried on a lower end, that includes ports for communicating fluid between the interior portion of the drill string and an uncased well bore. A packer, carried above the drill bit, is operable for sealingly closing a well annulus, A tester valve inserted in the drill string is operable for sealingly closing the drill string. The packer and tester valve are cooperatively operable for isolating a subsurface zone of interest. The system includes monitoring means inserted in the drill string for monitoring a parameter of well fluid from the subsurface zone. Once the subsurface zone is isolated, well fluid is communicated into the interior portion of the drill string through the ports of the drill bit, received by the monitoring means, and tested without removing the drill string form the well.

34 Claims, 4 Drawing Sheets

U.S. PATENT DOCUMENTS 4,347,900 A 9/1982 Barrington
4,375,239 A 3/1983 Barrington et al.
4,378,850 A 4/1983 Barrington
4,405,021 A * 9/1983 Mumby ..... 175/48
4,406,335 A 9/1983 Koot
4,615,399 A 10/1986 Schoeffler
4,676,096 A 6/1987 Bardsley et al.
4,745,802 A 5/1988 Purfurst
4,866,607 A 9/1989 Anderson et al.
4,898,236 A 2/1990 Sask
5,101,907 A 4/1992 Schultz et al.
5,230,244 A 7/1993 Gilbert
5,236,048 A 8/1993 Skinner et al.
5,303,775 A 4/1994 Michaels et al.
5,329,811 A 7/1994 Schultz et al.
5,332,048 A 7/1994 Underwood et al.
5,337,822 A 8/1994 Massie et al.
5,353,872 A * 10/1994 Wittrisch ..... 166/250.01
5,377,755 A 1/1995 Michaels et al.
5,428,293 A 6/1995 Sinclair et al.
5,540,280 A 7/1996 Schultz et al.
5,549,162 A 8/1996 Moody et al.
5,555,945 A 9/1996 Schultz et al.
5,558,162 A 9/1996 Manke et al.
5,583,827 A 12/1996 Chin
5,597,016 A 1/1997 Manke et al.
5,649,597 A 7/1997 Ringgenberg
5,687,791 A 11/1997 Beck et al.
5,743,334 A 4/1998 Nelson
RE35,790 E * 5/1998 Pustanyk et al. ..... 175/40
5,791,414 A 8/1998 Skinner et al.
5,799,733 A 9/1998 Ringgenberg et al.
5,803,186 A * 9/1998 Berger et al. ..... 175/50
5,807,082 A 9/1998 Skinner et al.
5,813,460 A 9/1998 Ringgenberg et al.
5,826,662 A 10/1998 Beck et al.
5,901,788 A 5/1999 Brown et al.
5,901,796 A 5/1999 McDonald
5,911,285 A 6/1999 Stewart et al.
5,959,547 A 9/1999 Tubel et al.
5,979,572 A 11/1999 Boyd et al.
6,006,834 A 12/1999 Skinner
6,026,915 A * 2/2000 Smith et al. ..... 175/50
6,051,973 A 4/2000 Prammer
6,065,355 A 5/2000 Schultz
6,157,893 A * 12/2000 Berger et al. ..... 702/9
6,189,612 B1 2/2001 Ward
6,236,620 B1 * 5/2001 Schultz et al. ..... 367/82
6,427,530 B1 * 8/2002 Krueger et al. ..... 73/152.46
6,640,908 B1 * 11/2003 Jones et al. ..... 175/50
2003/0141055 A1 * 7/2003 Paluch et al. ..... 166/254.2
2003/0234120 A1 * 12/2003 Paluch et al. ..... 175/50
2004/0035199 A1 * 2/2004 Meister et al. ..... 73/152.46

OTHER PUBLICATIONS

The Expro Group, "EXothermal Temperature Compensated Reservoir Fluid Sampling Tool", 102-CH/063, REV 02-12/00.

* cited by examiner 10
38
18
14
12
18,20
18,40
18,22
18,32
16
18,26
46
18,30
33
18,27
18,28
18,31
18,36

42
32
34
18,24
18,37

DRILLING FORMATION TESTER, APPARATUS AND METHODS OF TESTING AND MONITORING STATUS OF TESTER

This application is a continuation of International Patent Application No.: PCT/US00/30595, filed Nov. 6, 2000, which claims the benefit of U.S. Provisional Application No. 60/165,229, filed Nov. 5, 1999.

BACKGROUND OF THE INVENTION

1. Field of the Invention

The present invention relates to the drilling of oil and gas wells. In another aspect, the present invention relates to systems and methods for drilling well bores and evaluating subsurface zones of interest as the well bores are drilled into such zones. In even another aspect, the present invention relates to monitoring the operability of test equipment during the drilling process.

2. Description of the Related Art

It is well known in the subterranean well drilling and completion arts to perform tests on formations intersected by a wellbore. Such tests are typically performed in order to determine geological and other physical properties of the formations and fluids contained therein. For example, by making appropriate measurements, a formation's permeability and porosity, and the fluid's resistivity, temperature, pressure, and bubble point may be determined. These and other characteristics of the formation and fluid contained therein may be determined by performing tests on the formation before the well is completed.

It is of considerable economic importance for tests such as those described hereinabove to be performed as soon as possible after the formation has been intersected by the wellbore. Early evaluation of the potential for profitable recovery of the fluid contained therein is very desirable. For example, such early evaluation enables completion operations to be planned more efficiently. In addition, it has been found that more accurate and useful information can be obtained if testing occurs as soon as possible after penetration of the formation.

As time passes after drilling, mud invasion and filter cake buildup may occur, both of which may adversely affect testing. Mud invasion occurs when formation fluids are displaced by drilling mud or mud filtrate. When invasion occurs, it may become impossible to obtain a representative sample of formation fluids or at a minimum, the duration of the sampling period must be increased to first remove the drilling fluid and then obtain a representative sample of formation fluids.

Similarly, as drilling fluid enters the surface of the wellbore in a fluid permeable zone and leaves its suspended solids on the wellbore surface, filter cake buildup occurs. The filter cakes act as a region of reduced permeability adjacent to the wellbore. Thus, once filter cakes have formed, the accuracy of reservoir pressure measurements decrease, affecting the calculations for permeability and produceability of the formation. Where the early evaluation is actually accomplished during drilling operations within the well, the drilling operations may also be more efficiently performed, since results of the early evaluation may then be used to adjust parameters of the drilling operations. In this respect, it is known in the art to interconnect formation testing equipment with a drill string so that, as the wellbore is being drilled, and without removing the drill string from the wellbore, formations intersected by the wellbore may be periodically tested.

In typical formation testing equipment suitable for interconnection with a drill string during drilling operations, various devices or systems are provided for isolating a formation from the remainder of the wellbore, drawing fluid from the formation, and measuring physical properties of the fluid and the formation. Unfortunately, due to the constraints imposed by the necessity of interconnecting the equipment with the drill string, typical formation testing equipment is not suitable for use in these circumstances.

Typical formation testing equipment is unsuitable for use while interconnected with a drill string because they encounter harsh conditions in the wellbore during the drilling process that can age and degrade the formation testing equipement before and during the testing process. These harsh conditions include vibration from the drill bit, exposure to drilling mud and formation fluids, hydraulic forces of the circulating drilling mud, and scraping of the formation testing equipment against the sides of the wellbore.

Drill strings can extend thousands of feet underground. Testing equipment inserted with the drill string into the wellbore can therefore be at great distances from the earth's surface (surface). Therefore, testing equipment added to the drill string at the surface is often in the wellbore for days during the drilling process before reaching geologic formations to be tested. Also if there is a malfunction in testing equipment, removing the equipment from a well bore for repair can take a long time.

To determine the functional status or "health" of formation testing equipment designed to be used during the drilling process, one technique is to deploy and operate the testing equipment at time intervals prior to reaching formations to be tested. These early test equipment deployments to evaluate their status can expose that equipment to greater degradation in the harsh wellbore environment than without early deployment. It is well known in the art of logging-while-drilling (LWD) how to communicate from the surface to formation testing equipment in the wellbore. Such testing equipment can be turned on and off from the surface and data collected by the testing equipment can be communicated to the surface. A common method of communication between testing equipment in the wellbore and the surface is through pressure pulses in the drilling mud circulating between the testing equipment and the surface.

Another problem faced using formation test equipment on a drill string far down a wellbore is to ensure that a series of steps in a test sequence are carried out in the proper sequence at the proper time. Communication from the earth's surface to formation testing equipment far down a well by drilling mud pulse code can take a relatively long time. Also, mud pulse communication can be confused by other equipment-caused pulses and vibrations in the drilling mud column between the down-hole testing equipment and the earth's surface.

However, in spite of the above advancements, there still exists a need in the art for apparatus and methods for a way to monitor the functional status or health of the formation testing equipment prior to its use without deploying the system.

There is another need in the art for apparatus and methods for identifying early component failures in the formation testing equipment that can cause subsequent component failures that hide early precipitating failures, which do not suffer from the disadvantages of the prior art apparatus and methods. There is even another need in the art for apparatus and methods for accomplishing test sequences by formation testing equipment down-hole automatically upon an initiating signal from the earth's surface.

These and other needs in the art will become apparent to those of skill in the art upon review of this specification, including its drawings and claims.

SUMMARY OF THE INVENTION

It is an object of the present invention to provide for an integrated well drilling and evaluation system for drilling and logging a well and testing in an uncased well bore portion of the well. Generally the system of the invention comprises a drill string, a drill bit carried on a lower end of the drill string for drilling the well bore, a logging while drilling apparatus, a packer, a tester and a functional status monitor and the well can be selectively drilled, logged and tested without removing the drill string from the well. The logging while drilling apparatus is generally supported by the drill string, and during drilling and logging operations will generate data indicative of the nature of subsurface formations intersected by the uncased well bore, so that a formation or zone of interest may be identified without removing the drill string from the well. The packer is carried on the drill string above the drill bit, and is selectively positionable between a set packer position and an unset packer position. The set packer position allows for sealingly closing a well annulus between the drill string and the uncased well bore above the formation or zone of interest. The unset packer position allows the drill bit to be rotated to drill the well bore. The tester, preferably inserted in the drill string, allows for controlling flow of fluid between the formation and the drill string when the packer is in the set position. The functional status monitor, also included in the drill string, comprises sensors in communication with at least one of the logging while drilling apparatus, the packer, and the tester.

It is another object of the present invention to provide for an integrated drilling and evaluation system for drilling and logging a well and testing in an uncased well bore of the well. Generally the system comprises a drill string, a drill bit for drilling the well bore carried on a lower end of the drill string, a packer, a surge receptacle included in the drill string, a surge chamber means, a retrieval means, a logging while drilling means, a circulating valve included in the drill string above the surge receptacles, and a functional status monitor. The packer, which is carried on the drill string above the drill bit, allows for sealing a well annulus between the drill string and the uncased well bore above the drill bit. The surge chamber means is constructed to mate with the surge receptacle and allows for receiving and trapping a sample of well fluid within the surge chamber. The retrieval means allows for retrieving the surge chamber back to a surface location while the drill string remains in the uncased well bore. The logging while drilling means, included in the drill string, allows for generating data indicative of the nature of subsurface zones or formations intersected by the uncased well bore. The functional status monitor, also included in the drill string, comprises sensors in communication with at least one of the logging while drilling apparatus, the packer, surge receptacle, and circulating valve.

It is even another object of the present invention to provide for an integrated drilling and evaluation system for drilling and logging a well and testing in an uncased well bore portion of the well. Generally the system comprises a drill string, a drill bit carried on a lower end of the drill string and for drilling the well bore, a packer selectively positionable between set and unset positions, a valve, a logging while drilling means, a circulating valve, and a functional status monitor. Preferably, the packer allows for the sealing of a well annulus between the drill string and the uncased well bore above the drill bit. The valve, preferably included in the drill string, allows for controlling the flow of fluid between the well bore and the drill string when the packer is in said set position. The logging while drilling means, also included in the drill string, allows for logging subsurface zones or formations intersected by the uncased well bore. The circulating valve is preferably included in the drill string above the valve. Also included in the drill string is the functional status monitor which comprises sensors in communication with at least one of the logging while drilling apparatus, the packer, the circulating valve, and the valve.

It is yet another object of the present invention to provide for a method of early evaluation of a well having an uncased well bore intersecting a subsurface zone or formation of interest. Generally the method of the invention comprises the steps of: (a) providing a testing string in said well bore wherein the well bore comprises a tubing string, a logging tool included in the tubing string, a packer carried on the tubing string, a fluid testing device included in the tubing string; and a functional status monitor included in said tubing string; (b) logging the well with the logging tool and thereby determining the location of said subsurface zone or formation of interest; (c) setting the packer in the well bore above the subsurface formation and sealing a well annulus between the testing string and the well bore; (d) flowing a sample of well fluid from the subsurface formation below the packer to the fluid testing device; and (e) monitoring status of at least one of the logging tool, the packer, and the fluid testing device. Preferably the method of the invention is performed without removing the tubing string from the well bore after step (b).

It is still another object of the present invention to provide for an integrated drilling and evaluation apparatus for drilling a well and testing in an uncased well bore of a well. Generally the apparatus comprises a drill string, a drill bit, carried on a lower end of the drill string, for drilling the well bore, a packer, a fluid monitoring system included in the drill string, a tester valve, included in the drill string, and a function status monitor, included in the drill string, comprising sensors in communication with at least one of the packer, fluid monitoring system and the tester valve. The packer is carried on the drill string above the drill bit, and is selectively positionable between a set and unset position. When in the set position the packer allows for sealing against the uncased well bore and thereby isolates at least a portion of a formation or zone of interest intersected by the well bore. In the unset position, the packer disengages the uncased well bore, thereby allowing fluid flow between the packer and the uncased well bore when the drill bit is being used for drilling the well bore. The fluid monitoring system allows for determining fluid parameters of fluid in the formation or zone of interest and the tester valve allows for controlling flow of fluid from the formation or zone of interest into the drill string when the packer is in the set position. Preferably the well can be selectively drilled and tested without removing the drill string from the well.

It is even still another object of the present invention to provide for a method of early evaluation of a well having an uncased well bore. Generally the method comprises the steps of: (a) providing a drilling and testing string comprising a drill bit, a packer for sealingly engaging the well bore, which packer operates through a sequence of packer operational steps, a well fluid condition monitor, which monitor operates through a sequence of monitor operational steps, and a functional status monitor. The steps of the method further include (b) drilling the well bore with the drill bit until the well bore intersects a formation or zone of interest; (c) without removing the drilling and testing string from the well after step (b), effecting a seal with the packer against the uncased well bore and thereby isolating at least a portion of the formation or zone of interest; (d) without removing the drilling and testing string from the well bore, determining, with the well fluid condition monitor, fluid parameters of fluid in the formation or zone of interest; and (e) without removing the drilling and testing string from the well, determining whether at least one of the packer and well fluid condition monitor are functioning within acceptable parameters.

These and other objects of the present invention will become apparent to those of skill in the art upon review of this specification, including its drawings and claims.

DETAILED DESCRIPTION OF THE INVENTION

Figures 1A, 1B, 1C, 1D:
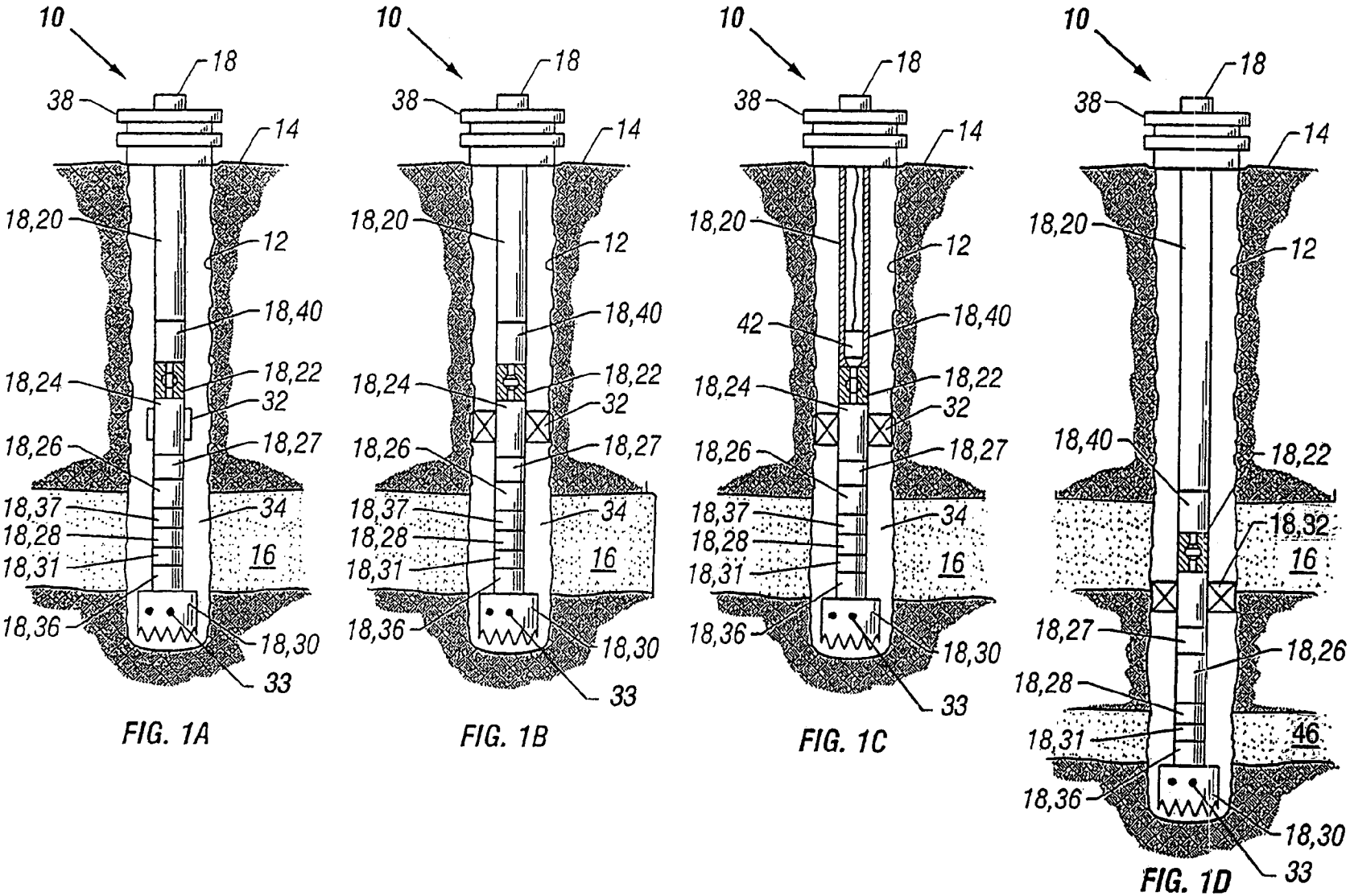
FIGS. 1A–1D provide a sequential series of illustrations in elevation which are sectioned, schematic formats showing the drilling of a well bore and the periodic testing of zones or formations of interest therein in accordance with the present invention.

Referring now to the drawings, and particularly to FIGS. 1A–1D, the apparatus and methods of the present invention are schematically illustrated.

A well 10 is defined by a well bore 12 extending downwardly from the earth's surface 14 and intersecting a first subsurface zone or formation of interest 16. A drill string 18 is shown in place within the well bore 12. The drill string 18 basically includes a coiled tubing or drill pipe string 20, a tester valve 22, packer means 24, a well fluid condition monitoring means 26, a logging while drilling means 28 and a drill bit 30.

The tester valve 22 may be generally referred to as a tubing string closure means for closing the interior of drill string 18 and thereby shutting in the subsurface zone or formation 16.

The tester valve 22 may, for example, be a ball-type tester valve as is illustrated in the drawings. However, a variety of other types of closure devices may be utilized for opening and closing the interior of drill string 18. One such alternative device is illustrated and described below with regard to FIG. 5. The packer means 24 and tester valve 22 may be operably associated so that the valve 22 automatically closes when the packer means 24 is set to seal the uncased well bore 12. For example, the ball-type tester valve 22 may be a weight set tester valve and have associated therewith an inflation valve communicating the tubing string bore above the tester valve with the inflatable packer element 32 when the closure valve 22 moves from its open to its closed position. Thus, upon setting down weight to close the tester valve 22, the inflation valve communicated with the packer element 32 is opened and fluid pressure within the tubing string 20 may be increased to inflate the inflatable packer element 32. Other arrangements can include a remote controlled packer and tester valve which are operated in response to remote command signals such as is illustrated below with regard to FIG. 5.

As will be understood by those skilled in the art, various other arrangements of structure can be used for operating the tester valve 22 and packer element 24. For example, both the valve and packer can be weight operated so that when weight is set down upon the tubing string, a compressible expansion-type packer element is set at the same time that the tester valve 22 is moved to a closed position.

The packer means 24 carries and expandable packer element 32 for sealing a well annulus 34 between the tubing string 18 and the well bore 12. The packing element 32 may be either a compression type packing element or an inflatable type packing element. When the packing element 32 is expanded to a set position as shown in FIG. 1B, it seals the well annulus 34 therebelow adjacent the subsurface zone or formation 16. The subsurface zone or formation 16 communicates with the interior of the testing string 18 through ports 33 present in the drill bit 30.

The well fluid condition monitoring means 26 contains instrumentation for monitoring and recording various well fluid perimeters such as pressure and temperature. It may for example be constructed in a fashion similar to that of Anderson et al., U.S. Pat. No. 4,866,607, assigned to the assignee of the present invention. The Anderson et al. device monitors pressure and temperature and stores it in an on board recorder. That data can then be recovered when the tubing string 18 is removed from the well. Alternatively, the well fluid condition monitoring means 26 may be a Halliburton RT-91 system which permits periodic retrieval of data from the well through a wire line with a wet connect coupling which is lowered into engagement with the device 26. This system is constructed in a fashion similar to that shown in U.S. Pat. No. 5,236,048 to Skinner et al., assigned to the assignee of the present invention. Another alternative monitoring system 26 can provide constant remote communication with a surface command station (not shown) through mud pulse telemetry or other remote communication system, as further described hereinbelow.

The logging while drilling means 28 is of a type known to those skilled in the art which contains instrumentation for logging subterranean zones or formations of interest during drilling. Generally, when a zone or formation of interest has been intersected by the well bore being drilled, the well bore is drilled through the zone or formation and the formation is logged while the drill string is being raised whereby the logging while drilling instrument is moved through the zone or formation of interest.

The logging while drilling tool may itself indicate that a zone or formation of interest has been intersected. Also, the operator of the drilling rig may independently become aware of the fact that a zone or formation of interest has been penetrated. For example, a drilling break may be encountered wherein the rate of drill bit penetration significantly changes. Also, the drilling cuttings circulating with the drilling fluid may indicate that a petroleum-bearing zone or formation has been intersected.

The logging while drilling means 28 provides constant remote communication with a surface command station by means of a remote communication system of a type described hereinbelow.

The drill bit 30 can be a conventional rotary drill bit and the drill string can be formed of conventional drill pipe. Preferably, the drill bit 30 includes a down hole drilling motor 36 for rotating the drill bit whereby it is not necessary to rotate the drill string. A particularly preferred arrangement is to utilize coiled tubing as the string 20 in combination with a steerable down hole drilling motor 36 for rotating the drill bit 30 and drilling the well bore in desired directions. When the drill string 18 is used for directional drilling, it preferably also includes a measuring while drilling means 37 for measuring the direction in which the well bore is being drilled. The measuring while drilling means 37 is of a type well known to those skilled in the art which provides constant remote communication with a surface command station.

Referring to FIGS. 1A–1D, and particularly FIG. 1A, the drill string 18 is shown extending through a conventional blow-out preventor stack 38 located at the surface 14. The drill string 18 is suspended from a conventional rotary drilling rig (not shown) in a well known manner. The drill string 18 is in a drilling position within the well bore 12, and it is shown after drilling the well bore through a first subsurface zone of interest 16. The packer element 32 is in a retracted position and the tester valve 22 is in an open position so that drilling fluids may be circulated down through the drill string 18 and up through the annulus 34 in a conventional manner during drilling operations.

During drilling, the well bore 12 is typically filled with a drilling fluid which includes various additives including weighting materials whereby there is an overbalanced hydrostatic pressure adjacent the subsurface zone 16. The overbalanced hydrostatic pressure is greater than the natural formation pressure of the zone 16 so as to prevent the well from blowing out.

After the well bore 12 has intersected the subsurface zone 16, and that fact has become known to the drilling rig operator as result of a surface indication from the logging while drilling tool 28 or other means, the drilling is continued through the zone 16. If it is desired to test the zone 16 to determine if it contains hydrocarbons which can be produced at a commercial rate, a further survey of the zone 16 can be made using the logging while drilling tool 28. As mentioned above, to facilitate the additional logging, the drill string 20 can be raised and lowered whereby the logging tool 28 moves through the zone 16.

Thereafter, a variety of tests to determine the hydrocarbon production capabilities of the zone 16 can be conducted by operating the tester valve 22, the packer means 24 and the well fluid condition monitoring means 26. Specifically, the packer 24 is set whereby the well annulus 34 is sealed and the tester valve 22 is closed to close the drill string 18, as shown in FIG. 1B. This initially traps adjacent the subsurface zone 16 the overbalance hydrostatic pressure that was present in the annulus 34 due to the column of drilling fluid in the well bore 12. The fluids trapped in the well annulus 34 below packer 24 are no longer communicated with the column of drilling fluid, and thus, the trapped pressurized fluids will slowly leak off into the surrounding subsurface zone 16, i.e., the bottom hole pressure will fall-off. The fall-off of the pressure can be utilized to determine the natural pressure of the zone 16 using the techniques described in our copending application entitled Early Evaluation By Fall-Off Testing, designated as attorney docket number HRS 91.225B1, filed concurrently herewith, the details of which are incorporated herein by reference. As will be understood, the well fluid condition monitoring means 26 continuously monitors the pressure and temperature of fluids within the closed annulus 34 during the pressure fall-off testing and other testing which follows.

Other tests which can be conducted on the subsurface zone 16 to determine its hydrocarbon productivity include flow tests. That is, the tester valve 22 can be operated to flow well fluids from the zone 16 to the surface at various rates. Such flow tests which include the previously described draw-down and build-up tests, open flow tests and other similar tests are used to estimate the hydrocarbon productivity of the zone over time. Various other tests where treating fluids are injected into the zone 16 can also be conducted if desired.

Depending upon the particular tests conducted, it may be desirable to trap a well fluid sample without the necessity of flowing well fluids through the drill string to the surface. A means for trapping such a sample is schematically illustrated in FIG. 1C. As shown in FIG. 1C, a surge chamber receptacle 40 is included in the drill string 20 along with the other components previously described. In order to trap a sample of the well fluid from the subsurface zone 16, a surge chamber 42 is run on a wire line 44 into engagement with the surge chamber receptacle 40. The surge chamber 42 is initially empty or contains atmospheric pressure, and when it is engaged with the surge chamber receptacle 40, the tester valve 22 is opened whereby well fluids from the subsurface formation 16 flow into the surge chamber 42. The surge chamber 42 is then retrieved with the wire line 44. The surge chamber 42 and associated apparatus may, for example, be constructed in a manner similar to that shown in U.S. Pat. No. 3,111,169 to Hyde, the details of which are incorporated herein by reference.

After the subsurface zone 16 is tested as described above, the packer 24 is unset, the tester valve 22 is opened and drilling is resumed along with the circulation of drilling fluid through the drill string 20 and well bore 12.

FIG. 1D illustrates the well bore 12 after drilling has been resumed and the well bore is extended to intersect a second subsurface zone or formation 46. After the zone or formation 46 has been intersected, the packer 24 can be set and the tester valve 22 closed as illustrated to perform pressure fall-off tests, flow tests and any other tests desired on the subsurface zone or formation 46 as described above.

As will now be understood, the integrated well drilling and evaluation system of this invention is used to drill a well bore and to evaluate each subsurface zone or formation of interest encountered during the drilling without removing the drill string from the well bore. Basically, the integrated drilling and evaluation system includes a drill string, a logging while drilling tool in the drill string, a packer carried on the drill string, a tester valve in the drill string for controlling the flow of fluid into or from the formation of interest from or into the drill string, a well fluid condition monitor for determining conditions such as the pressure and temperature of the well fluid and a drill bit attached to the drill string. The integrated drilling and evaluation system is used in accordance with the methods of this invention to drill a well bore, to log subsurface zones or formations of interest and to test such zones or formations to determine the hydrocarbon productivity thereof, all without moving the system from the well bore.

Figures 2A, 2B, 2C, 3:
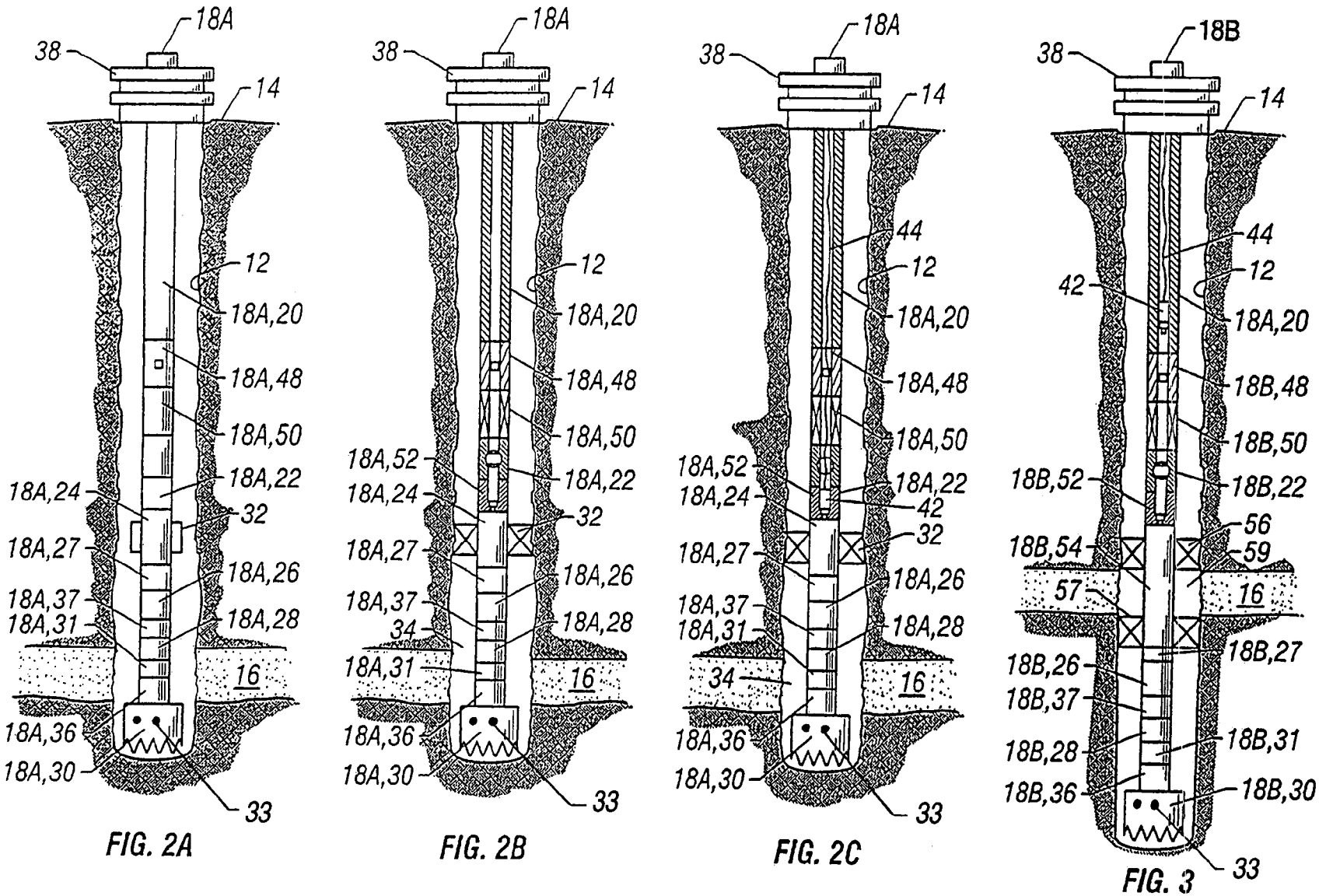
FIGS. 2A–2C comprise a sequential series of illustrations similar to FIGS. 1A–1C showing an alternative embodiment of the apparatus of this invention.
FIG. 3 is a schematic illustration of another alternative embodiment of the apparatus of this invention.

FIGS. 2A–2C are similar to FIGS. 1A–1C and illustrate a modified drill string 18A. The modified drill string 18A is similar to the drill string 18, and identical parts carry identical numerals. The drill string 18A includes three additional components, namely, a circulating valve 48, an electronic control sub 50 located above the tester valve 22 and a surge chamber receptacle 52 located between the tester valve 22 and the packer 24.

After the packer element 24 has been set as shown in FIG. 2B, the tester valve 22 is closed and the circulating valve 48 is open whereby fluids can be circulated through the well bore 12 above the circulating valve 48 to prevent differential pressure drill string sticking and other problems.

The tester valve 22 can be opened and closed to conduct the various tests described above including pressure fall-off tests, flow tests, etc. As previously noted, with any of the tests, it may be desirable from time to time to trap a well fluid sample and return it to the surface for examination. As shown in FIG. 2C, a sample of well fluid may be taken from the subsurface zone or formation 16 by running a surge chamber 42 on a wire line 44 into engagement with the surge chamber receptacle 52. When the surge chamber 42 is engaged with the surge chamber receptacle 52, a passageway communicating the surge chamber 42 with the subsurface zone or formation 16 is opened so that well fluids flow into the surge chamber 42. The surge chamber 42 is then retrieved with the wire line 44. Repeated sampling can be accomplished by removing the surge chamber, evacuating it and then running it back into the well.

Referring now to FIG. 3 another modified drill string 18B is illustrated. The modified drill string 18B is similar to the drill string 18A of FIGS. 2A–2C, and identical parts carry identical numerals. The drill string 18B is different from the drill string 18A in that it includes a straddle packer 54 having upper and lower packer elements 56 and 57 separated by a packer body 59 having ports (not shown) therein for communicating the bore of tubing string 20 with the well bore 12 between the packer elements 56 and 57.

After the well bore 12 has been drilled and the logging while drilling tool 28 has been operated to identify the various zones of interest such as the subsurface zone 16, the straddle packer elements 56 and 57 are located above and below the zone 16. The inflatable elements 56 and 57 are then inflated to set them within the well bore 12 as shown in FIG. 3. The inflation and deflation of the elements 56 and 57 are controlled by physical manipulation of the tubing string 20 from the surface. The details of construction of the straddle packer 54 may be found in our copending application entitled Early Evaluation System, designated as attorney docket number HRS 91.225A1, filed concurrently herewith, the details of which are incorporated herein by reference.

Figure 4:
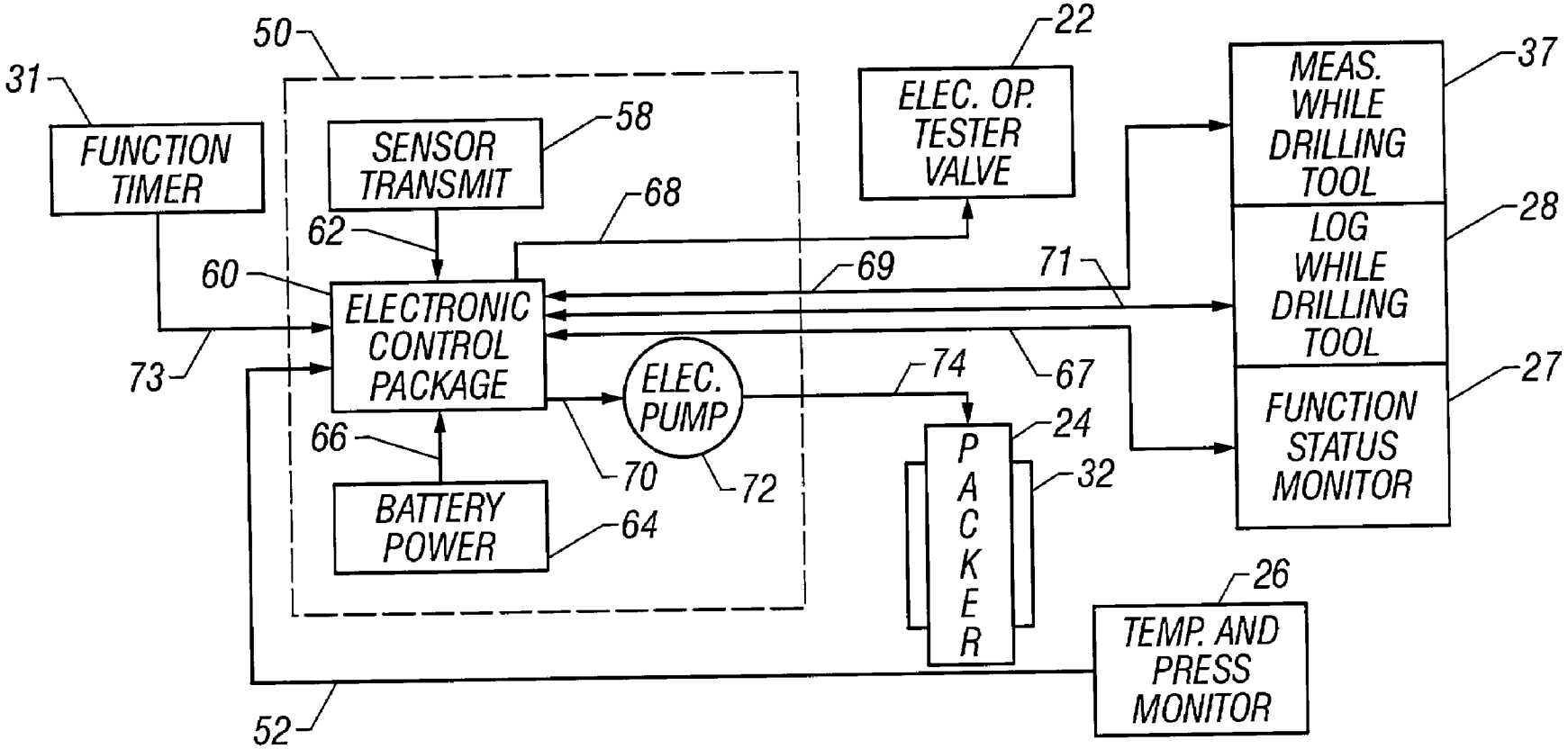
FIG. 4 is a schematic illustration of an electronic remote control system for controlling various tools in the drill string from a surface control station.

The drill strings 18A and 18B both include an electronic control sub 50 for receiving remote command signals from a surface control station. The electronic control system 50 is schematically illustrated in FIG. 4. Referring to FIG. 4, electronic control sub 50 includes a sensor transmitter 58 which can receive communication signals from a surface control station and which can transmit signals and data back to the surface control station. The sensor/transmitter 58 is communicated with an electronic control package 60 through appropriate interfaces 62. The electronic control package 60 may for example be a microprocessor based controller. A battery pack 64 provides power by way of power line 66 to the control package 60.

The electronic control package 60 generates appropriate drive signals in response to the command signals received by sensor/transmitter 58, and transmits those drive signals over electric lines 68 and 70 to an electrically operated tester valve 22 and an electric pump 72, respectively. The electrically operated tester valve 22 may be the tester valve 22 schematically illustrated in FIGS. 1A–1D, 2A–2C and FIG. 3. The electronically powered pump 72 takes well fluid from either the annulus 34 or the bore of tubing string 20 and directs it through hydraulic line 74 to the inflatable packer 24 to inflate the inflatable element 32 thereof.

Thus, the electronically controlled system shown in FIG. 4 can control the operation of tester valve 22 and inflatable packer 24 in response to command signals received from a surface control station. Also, the measuring while drilling tool 37, the logging while drilling tool 28, the functional status monitor 26, may be connected with the electronic control package 60 over electric lines 69, 71, 67, and 73, respectively, and the control package 60 can transmit data generated by the measuring while drilling tool 37, the logging while drilling tool 28, the functional status monitor 27, the function timer 31 and the well fluid condition monitor 26 to the surface control station while the drill strings 18A and 18B remain in the well bore 12.

Functional status monitor 27 has at least three benefits: (1) it warns of system degradation, while still potentially operational; (2) it warns of test system problems that can put the entire drilling operation at risk; and (3) it identifies component failure.

While drilling formation tester (DFT) tools comprising tester valve 22, circulating valve 48, packers 32, 56 and 57 are in "sleep" or low power mode, functional status monitor 27 occasionally monitors sensors to check the functional status of the test system. A status bit can be sent to indicate that the tool has a change in functional status. Such a status message would alert an operator that a potential problem could occur. An attached LWD communication system would report the status bit change to the operator. The functional status monitor 27 may comprise independent electronics or may be part of the tool electronics. The status monitor 27 function includes sensors that monitor the system.

Depending upon the types of sensors utilized, the functional status monitor evaluates one or more of the following:

(1) hydraulic pressure to indicate hydraulic power system functional status;
(2) oil reserve volume to indicate leakage;
(3) circulating valve position to indicate false activation;
(4) circulating valve leakage to indicate washout possibility; and
(5) packer position to indicate inflation or attachment to borehole.

It should be understood that any suitable definition scheme can be utilized for assigning meaning to the information bits. As a non-limiting example, one possible system for assigning meaning to information bits is the following:

Bit 14: This bit identifies the meaning of following bits. If Bit 14=0 then Bits 13 to 00 represent pressure data (REPO) with a LSB value of 0.25 PSI. If Bit 14=1 the remaining bits represents DFT tool status (REST).

Bit 13: If this bit is set to 1 (in addition to bit 14=1 then bits 12 to 00 represent the minimum pressure (REPM) encountered during the draw down portion of the formation test with a LSB value of 0.5 PSI. Minimum pressure is only transmitted once during the build up period of the formation test.

Bit 12: If this bit is set to 1 (in addition to bit 14=1 then bits 11 to 04 represent draw down flow rate (REDQ) in cc/sec. The LSB value of this variable is 1 cc/sec.

Bit 11 & Bit 10: Bits 11 & 10 identify status of the hydraulic system as shown:

Bit 11 Bit 10
0 0 Hydraulic Pressure Off
0 1 Hydraulic Pressure Low 1 0 Hydraulic Pressure OK 1 1 Hydraulic Pressure High Bit 09: Identifies the Circulating valve function. A value of 0 indicates the Circulating valve is off (de-activated) while a 1 tells that the Circulating valve is activated.

Bit 08: Is the Circulating valve status. A value of 0 indicates the Circulating valve operated OK while a value of 0 shows the Circulating valve operation failed.

Bit 07: Identifies the Packer function. A value of 0 indicates the Packers are off (deflated) while a 1 shows that the Packers are activated.

Bit 06: This bit shows the packer status. A value of 0 indicates the Packers are OK. A value of 1 shows the Packer failed to inflate properly.

Bit 05: Identifies Draw Down function. A value of 0 indicates the Draw Down is off, a value of 1 shows the Draw Down function is on.

Bit 04: This bit shows the draw down status. A value of 0 shows the draw down is OK, a value of 1 shows the draw down failed.

Bit 03: Base Line Pressure (REBP) MSB

Bit 02: Base Line Pressure (REBP)

Bit 01: Base Line Pressure (REBP)

Bit 00: Base Line Pressure (REBP) LSB

Also shown in FIG. 4 is a function timer 31. Timer 31 acts to control the sequence of sampling steps of formation fluids after receiving an initiating signal from the earth's surface via sensor transmitter 58. Timer 31 controls the sequence and timing of activation and deactivation of circulating valve 48; packers 32, 56 and 57; and tester valve 22 for the purpose of collecting formation fluid samples from such a geologic formation as formation 16. Timer 31 activates circulating valve 48 above packers 32, 56, and 57 to circulate mud above the packers to prevent drill line sticking and allow mud pulse communication with the surface. Timer 31 then controls the inflation of packers 32 or 56 and 57 to isolate a portion of formation 16 face. Then timer 31 controls the activation of tester valve 22 to draw down test of formation fluid as previously described or to collect a sample of formation fluid for transport to the surface or storage in surge chamber 42.

Figure 5:
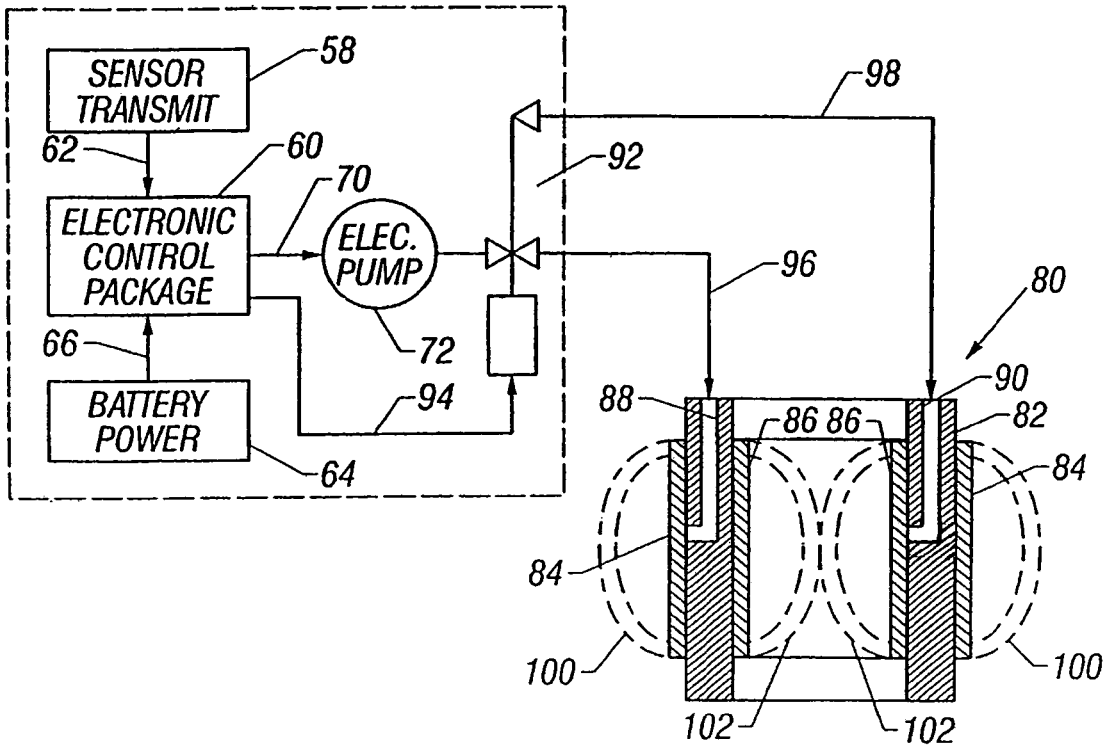
FIG. 5 is a schematic illustration similar to FIG. 4 which also illustrates a combination inflatable packer and closure valve.

FIG. 5 illustrates an electronic control sub 50 like that of FIG. 4 in association with a modified combined packer and tester valve means 80. The combination packer/closure valve 80 includes a housing 82 having an external inflatable packer element 84 and an internal inflatable valve closure element 86. An external inflatable packer inflation passage 88 defined in housing 82 communicates with the external inflatable packer element 84. A second inflation passage 90 defined in the housing 82 communicates with the internal inflatable valve closure element 86. As illustrated in FIG. 5, the electronic control sub 50 includes an electronically operated control valve 92 which is operated by the electronic control package 60 by way of an electric line 94. One of the outlet ports of the valve 92 is connected to the external inflatable packer element inflation passage 88 by a conduit 96, and the other outlet port of the valve 92 is connected to the internal inflatable valve closure inflation passage 90 by a conduit 98.

When fluid under pressure is directed through hydraulic conduit 96 to the passage 88, it inflates the external packer elements to the phantom line positions 100 shown in FIG. 5 so that the external packer element 84 seals off the well annulus 34. When fluid under pressure is directed through the hydraulic conduit 98 to the passage 90, it inflates the internal valve closure element 86 to the phantom line positions 102 shown in FIG. 5 so that the internal inflatable valve closure element 86 seals off the bore of the drill string 18. When fluid under pressure is directed through both the conduits 96 and 98, both the external packer element 84 and internal valve element 86 are inflated. Thus, the electronic control sub 50 in combination with the packer and valve apparatus 80 can selectively set and unset the packer 84 and independently selectively open and close the inflatable valve element 86.

As will be understood, many different systems can be utilized to send command signals from a surface location down to the electronic control sub 50. One suitable system is the signaling of the electronic control package 60 of the sub 50 and receipt of feedback from the control package 60 using acoustical communication which may include variations of signal frequencies, specific frequencies, or codes of acoustic signals or combinations of these. The acoustical transmission media includes tubing string, electric line, slick line, subterranean soil around the well, tubing fluid and annulus fluid. An example of a system for sending acoustical signals down the tubing string is disclosed in U.S. Pat. Nos. 4,375,239; 4,347,900; and 4,378,850 all to Barrington and assigned to the assignee of the present invention. Other systems which can be utilized include mechanical or pressure activated signaling, radio wave transmission and reception, microwave transmission and reception, fiber optic communications, and the others which are described in U.S. Pat. No. 5,555,945 to Schultz et al., the details of which are incorporated herein by reference.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

We claim:

1. An integrated well drilling and evaluation system for drilling and logging a well and testing in an uncased well bore portion of the well, comprising:

a drill string having an interior portion;

a drill bit carried on a lower end of the drill string, for drilling the well bore, wherein the drill bit includes ports for communicating fluid between the interior portion of the drill string and the uncased well bore;

a packer, carried on the drill string above the drill bit, having a set position for sealingly closing a well annulus between the drill string and the uncased well bore above a subsurface zone of interest and having an unset position such that the drill bit may be rotated to drill the well bore, the packer being selectively positionable between the set position and the unset position;

a tester valve, inserted in the drill string, wherein the tester valve has an open position and a closed position for sealingly closing the interior portion of the drill string, the tester valve being selectively positionable between the open position and the closed position and is cooperatively operable with the packer to shut in the subsurface zone, and with the packer in the set position, the tester valve is operable to be selectively moved to the open position to allow well fluid from the subsurface zone to pass through die interior portion of the drill string to a surface location;

monitoring means, inserted in the drill string, for monitoring a parameter of well fluid from the subsurface zone, wherein when the packer is in the set position and the tester valve is in the closed position, well fluid from the subsurface zone is communicated into the interior portion of the drill string through the ports of the drill bit, received by the monitoring means, and tested without removing the drill string from the well;

an electronic control package that is cooperative operable with and controls the operation of a least the packer and the tester valve;

a function timer that is cooperatively operable with die electronic control package to control the sequence of sampling for collecting well fluid from the subsurface zone after receiving an initiating signal from a surface location; and a functional status monitor, included in the drill string and separate from the function timer and the electronic control package, comprising at least one sensor for monitoring a functional status of at least one of the monitoring means, the packer, and the tester valve.

2. The system of claim 1, wherein the functional status monitor is operable to communicate the functional status to a surface location.

3. The system of claim 2, wherein, in response to a change in functional status, the functional status monitor is operable to change a value of a corresponding status bit in a binary information string that is communicated to the surface location.

4. The system of claim 1, wherein monitoring a functional status of at least one of the monitoring means, the packer, and the tester valve comprises evaluating at least one of hydraulic pressure, packer position, and tester valve position.

5. The system of claim 1, wherein the tester valve and the packer are a combination closure valve operable to shut in the subsurface zone, and the combination closure valve includes:

a housing;

an external inflatable packer element attached to an outer portion of the housing adjacent the well bore, wherein the external inflatable packer element is selectively positionable between an inflated position and a deflated position, and when placed in the inflated position, the external inflatable packer element is operable for sealingly closing the well annulus between the drill string and the uncased well bore; and an internal inflatable packer element attached to an inner portion of the housing adjacent the interior portion of the drill string, wherein the internal inflatable packer element is selectively positionable between an inflated position and a deflated position, and when placed in the inflated position, the internal inflatable packer element is operable for sealingly closing the interior portion of the drill string.

6. The system of claim 5, further comprising:

an external inflatable packer passage defined in the housing tat is in fluid communication with the external inflatable packer element;

an internal inflatable packer passage defined in the housing that is in fluid communication with the internal inflatable packer element; and a control valve having a first outlet port in fluid communication with the external inflatable packer passage, and a second outlet port in fluid communication with the internal inflatable packer passage, wherein the control valve is operable to selectively pass pressurized fluid to the external and internal inflatable packer passages to selectively inflate the external and internal inflatable packer elements.

7. The system of claim 6, wherein the control valve is an electronically operated control valve coupled to a control module inserted in the drill string, wherein the control module is also coupled to an electric pump that is in fluid communication with the control valve, and when activated by the control module, the electric pump pressurizes fluid that is directed through the control valve for inflating at least one of the external and internal inflatable packer elements.

8. The system of claim 1, further comprising:

logging while drilling apparatus, carried by the drill string, that during drilling is operable to generate data indicative of the nature of subsurface formations intersected by the uncased well bore, wherein the subsurface zone is identifiable without removing the drill string from the well.

9. The system of claim 1, further comprising:

a circulating valve, carried by the drill string above the tester valve, for circulating drilling fluid when the packer is in the set position and the tester valve is in the closed position.

10. An integrated well drilling and evaluation system for drilling and logging a well and testing in an uncased well bore portion of the well, comprising:

a drill string having an interior portion;

a drill bit, carried on a lower end of the drill string, for drilling the well bore;

a combination closure valve, carried on the drill string above the drill bit, operable to shut in a subsurface zone of interest, wherein the combination closure valve includes:

a housing;

an external inflatable packer element attached to an outer portion of the housing adjacent the well bore, wherein the external inflatable packer element is selectively positionable between an inflated position and a deflated position, and when placed in the inflated position, the external inflatable packer element is operable for sealingly closing a well annulus between the drill string and the uncased well bore; and an internal inflatable packer element attached to an inner portion of the housing adjacent the interior portion of the drill string, wherein the internal inflatable packer element is selectively positionable between an inflated position and a deflated position, and when placed in the inflated position, the internal inflatable packer element is operable for sealingly closing the interior portion of the drill string, and with the external packer element inflated, the internal packer element is operable to be selectively deflated to allow well fluid from the subsurface zone or formation to pass through the interior portion of the drill string to a surface location;

monitoring means, inserted in the drill string, for monitoring a parameter of well fluid from the subsurface zone or formation, wherein the monitoring means receives the well fluid and tests the well fluid without removing the drill string from the well;

an electronic control package that is cooperative operable with and controls the operation of a least one of the combination closure valve and the monitoring means;

a function timer that is cooperatively operable with the electronic control package to control the sequence of sampling for collecting well fluid from the subsurface zone after receiving an initiating signal from a surface location; and a functional status monitor, included in the drill string and separate from the function timer and the electronic control package, comprising at least one sensor for monitoring a functional status of at least one of the monitoring means and the combination closure valve.

11. The system of claim 10, wherein the functional status monitor is operable to communicate the functional status to a surface location.

12. The system of claim 11, wherein, in response to a change in functional status, the functional status monitor is operable to change a value of a corresponding status bit in a binary information string that is communicated to the surface location.

13. The system of claim 10, wherein monitoring a functional status of at least one of the monitoring means and the combination closure valve comprises evaluating at least one of hydraulic pressure, an external inflatable packer position, and an internal inflatable packer position.

14. The system of claim 10, wherein the monitoring means is operable for receiving the well fluid from the interior portion of the drill string.

15. The system of claim 14, wherein the drill bit includes ports for communicating fluid between the interior portion of the drill string and the uncased well bore.

16. The system of claim 14, further comprising:

a valve for communicating well fluid from the subsurface zone or formation into the interior portion of the drill string.

17. The system of claim 10, further comprising:

a packer, carried on the drill string below the combination closure valve and above the drill bit, having a set position for sealingly closing the well annulus between the drill string and the uncased well bore and having an unset position such that the drill bit may be rotated to drill the well bore, the packer being selectively positionable between the set position and the unset position, wherein the packer is cooperatively operable with the combination closure valve to isolate at least a portion of The subsurface zone from the remaining portion of the uncased well bore.

18. The system of claim 10, further comprising:

an external inflatable packer passage defined in the housing that is in fluid communication with the external inflatable packer element;

an internal inflatable packer passage defined in the housing that is in fluid communication with the internal inflatable packer element; and a control valve having a first outlet port in fluid communication with the external inflatable packer passage, and a second outlet port in fluid communication with the internal inflatable packer passage, wherein the control valve is operable to selectively pass pressurized fluid to the external and internal inflatable packer passages to selectively inflate the external and internal inflatable packer elements.

19. The system of claim 18, wherein the control valve is an electronically operated control valve coupled to a control module inserted in the drill string, wherein the control module is also coupled to an electric pump that is in fluid communication with the control valve, and when activated by the control module, the electric pump pressurizes fluid that is directed through the control valve for inflating at least one of the external and internal inflatable packer elements.

20. The system of claim 10, further comprising:

logging while drilling apparatus, carried by the drill string, that during drilling is operable to generate data indicative of the nature of subsurface formations intersected by the uncased well bore, wherein the subsurface zone is identifiable without removing the drill string from the well.

21. The system of claim 10, further comprising:

a circulating valve, carried by the drill string above the interior inflatable element of the combination closure valve, for circulating drilling fluid when the interior inflatable element and the exterior inflatable element are in inflated positions.

22. A method for early evaluation of a well having an uncased well bore intersecting a subsurface zone of interest, comprising:

drilling a well with a drill string having an interior portion and a drill bit carried on a lower end of the drill string, wherein the drill bit includes ports for communicating fluid between the interior portion of the drill string and the uncased well bore;

during drilling operations, attaching a test string to the drill string and continuing to drill the well until the test string is at a position proximate the subsurface zone, wherein the test string includes:

a packer having a set position for sealingly closing a well annulus between the drill string and the uncased well bore above the subsurface zone and having an unset position such that the drill bit may be rotated to drill the well bore, the packer being selectively positionable between the set position and the unset position;

a tester valve having an open position and a closed position for sealingly closing the interior portion of the drill string, the tester valve being selectively positionable between the open position and the closed position and is cooperatively operable with the packer to shut in the subsurface zone, and with the packer in the set position, the tester valve is operable to be selectively moved to the open position to allow well fluid from the subsurface zone to pass through the interior portion of the drill string to a surface location;

monitoring means for monitoring a parameter of well fluid from the subsurface zone;

an electronic control package that is cooperative operable with and controls the operation of a least the packer and the tester valve;

a function timer that is cooperatively operable with the electronic control package to control the sequence of sampling for collecting well fluid from the subsurface zone after receiving an initiating signal from a surface location; and a functional status monitor, included in the drill string and separate from the function timer and the electronic control package, comprising at least one sensor for monitoring a functional status of at least one of the monitoring means, the packer, and the tester valve;

without removing the drill string from the well, shutting in the subsurface zone by:

positioning the packer above the subsurface zone and sealing a well annulus between the test string and the well bare by placing the packer in the set position; and sealing the interior portion of the drill string by placing the tester valve in the closed position;

receiving, at the monitoring means, well fluid communicated to the interior portion of the drill string through the ports in the drill bit;

monitoring at least one parameter of the well fluid from the subsurface zone; and monitoring a functional status of at least one of the monitoring means, the packer, and the tester valve.

23. The method of claim 22, further comprising:

communicating the functional status to a surface location.

24. The method of claim 23, wherein communicating the functional status to a surface location comprises:

changing a value of a corresponding status bit in a binary information string in response to a change in functional status; and communicating the binary information string to the surface location.

25. The method of claim 22, wherein monitoring a functional status of at least one of the monitoring means, the packer, and the tester valve comprises evaluating at least one of hydraulic pressure, packer position, and tester valve position.

26. The method of claim 22, wherein the test string further includes a logging while drilling apparatus, the method further comprising:

during drilling operations, receiving data at a surface location from the logging while drilling apparatus that is indicative of the nature of the subsurface zone intersected by the uncased well bore, wherein the subsurface zone is identifiable without removing the drill string from the well.

27. The method of claim 22, wherein the test string further includes a circulating valve located above the tester valve, the method further comprising:

after shutting in the subsurface zone, opening the circulating valve; and circulating drilling fluid through the well annulus above the packer.

28. A method for early evaluation of a well having an uncased well bore intersecting a subsurface zone of interest, comprising:

drilling a well with a drill string having an interior portion and a drill bit carried on a lower end of the drill string;

during drilling operations, attaching a test string to the drill string and continuing to drill the well until the test string is at a position proximate the subsurface zone, wherein the test string includes:

a combination closure valve operable to shut in the subsurface zone, wherein the combination closure valve includes:

a housing;

an external inflatable packer element attached to an outer portion of the housing adjacent the well bore, wherein the external inflatable packer element is selectively positionable between an inflated position and a deflated position, and when placed in the inflated position, the external inflatable packer element is operable for sealingly closing a well annulus between the drill string and the uncased well bore; and an internal inflatable packer clement attached to an inner portion of the housing adjacent the interior portion of the drill string, wherein the internal inflatable packer element is selectively positionable between an inflated position and a deflated position, and when placed in the inflated position, the internal inflatable packer element is operable for sealingly closing the interior portion of the drill string, and with the external packer element inflated, the internal packer element is operable to be selectively deflated to allow well fluid from the subsurface zone or formation to pass through the interior portion of the drill string to a surface location;

monitoring means for monitoring a parameter of well fluid from the subsurface zone;

an electronic control package that is cooperative operable with and controls the operation of a least one of the combination closure valve and the monitoring means;

a function timer that is cooperatively operable with the electronic control package to control the sequence of sampling for collecting well fluid from the subsurface zone after receiving an initiating signal from a surface location; and a functional status monitor, included in the drill string and separate from the function timer and the electronic control package, comprising at least one sensor for monitoring a functional status of at least one of the monitoring means and the combination closure valve receiving, at the monitoring means, well fluid from the subsurface zone;

monitoring at least one parameter of the well fluid; and monitoring a functional status of at least of the monitoring means and the combination closure valve.

29. The method of claim 28, further comprising:

communicating the functional status to a surface location.

30. The method of claim 29, wherein communicating the functional status to a surface location comprises:

changing a value of a corresponding status bit in a binary information string in response to a change in functional status; and communicating the binary information string to the surface location.

31. The method of claim 28, wherein monitoring a functional status of at least one of the monitoring means and the combination closure valve comprises evaluating at least one of hydraulic pressure, external inflatable packer position, and internal inflatable packer position.

32. The method or claim 28, wherein the test string further includes a packer, below the combination closure valve, having a set position for sealingly closing the well annulus between the drill string and the uncased well bore and having an unset position such that the drill bit may be rotated to drill the well bore, the parker being selectively positionable between the set position and the unset position, the method further comprising:

placing the packer in the set position to isolate at least a portion of the subsurface zone from the remaining portion of the uncased well bore.

33. The method of claim 28, wherein the test string further includes a logging while drilling apparatus, the method further comprising:

during drilling operations, receiving data at a surface location from the logging while drilling apparatus that is indicative of the nature of the subsurface zone intersected by the uncased well bore, wherein the subsurface zone is identifiable without removing the drill string from the well.

34. The method of claim 28, wherein the test string further includes a circulating valve located above the combination closure valve, the method further comprising:

after shutting in the subsurface zone, opening the circulating valve; and circulating drilling fluid through the well annulus above the packer.

* * * * *